US006926162B1

(12) United States Patent
Culley

(10) Patent No.: US 6,926,162 B1
(45) Date of Patent: Aug. 9, 2005

(54) TAMPER INDICATING BAND ARRESTER

(75) Inventor: Brian K. Culley, Mt. Vernon, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 10/068,320

(22) Filed: Feb. 5, 2002

(51) Int. Cl.[7] ..... B65D 41/34; B65D 50/00

(52) U.S. Cl. ..... 215/252; 215/258; 215/329; 215/344; 215/901

(58) Field of Search ..... 215/252, 344, 215/223, 253, 329, 341, 901, 258, 256

(56) References Cited

U.S. PATENT DOCUMENTS

| | | | | |
|---|---|---|---|---|
| 3,455,479 A | | 7/1969 | Hadley et al. | |
| 4,156,490 A | | 5/1979 | Peraboni | |
| 4,343,408 A | | 8/1982 | Csaszar | |
| 4,380,299 A | | 4/1983 | Alejandro Llera | |
| 4,461,390 A | | 7/1984 | Csaszar | |
| 4,479,586 A | | 10/1984 | Csaszar | |
| 4,485,934 A | | 12/1984 | Maguire | |
| 4,509,654 A | | 4/1985 | Maguire | |
| 4,550,845 A | * | 11/1985 | Guala | 215/252 |
| 4,560,076 A | | 12/1985 | Boik | |
| 4,565,295 A | * | 1/1986 | Mori et al. | 215/252 |
| 4,669,623 A | | 6/1987 | Csaszar | |
| 4,848,614 A | | 7/1989 | Csaszar | |
| 4,907,708 A | | 3/1990 | Csaszar | |
| 5,573,128 A | | 11/1996 | Tsujiguchi et al. | |
| 5,648,037 A | | 7/1997 | Franchet et al. | |
| 5,829,612 A | * | 11/1998 | Zumbuhl | 215/252 |
| 5,957,315 A | * | 9/1999 | Kaitsuka | 215/252 |
| 6,102,224 A | | 8/2000 | Sun et al. | |

FOREIGN PATENT DOCUMENTS

EP 0 475 672 A1 5/1990

* cited by examiner

*Primary Examiner*—Lee Young
*Assistant Examiner*—Niki M. Eloshway
(74) *Attorney, Agent, or Firm*—Middleton Reutlinger

(57) ABSTRACT

A tamper indicating band arrester is described herein for use with a container neck or finish bead comprising an upper portion and a lower portion. The TI band has an annular step having a smaller diameter than the lower portion of the finish bead. The TI band further comprises a TI bead which positioned beneath the lower portion of the container neck or finish bead. The plurality of frangible webs or bridges are located above the annular step and adjacent the upper portion of the finish bead. The thickened cross section of the annular step provides interference between the TI band and container neck bead inhibiting the TI band from tiring over the container neck bead when opened.

13 Claims, 6 Drawing Sheets

TAMPER INDICATING BAND ARRESTER

BACKGROUND OF THE INVENTION

1. Technical Field of the Invention

The present invention relates generally to a Tamper Indicating Band ("TI band" hereinafter). More particularly, the design relates to a TI band aiding in full fracture of frangible webs and inhibiting "tiring" of the TI band over a container finish bead.

2. Description of the Related Art

TI bands are known in the art as having frangible bridges or webs that attach the band to a closure skirt. Ideally, when initially unscrewed, all of the frangible bridges or webs should break resulting in detachment of the TI band from the closure and leaving the TI band attached around the neck of the container. However, in most cases not all of the frangible webs will break. In reality, what occurs is that there is an attached portion and a detached portion of frangible webs. Typically, the detached portion of TI band falls below a lower portion of a neck or finish bead and shifts inward toward the container neck. Since the detached portion shifts inward, the attached portion necessarily moves away from the container neck finish and the outer perimeter of the neck finish or container bead. As the closure is unscrewed, the attached portion "tires" over the container bead. This often results in the TI band being pulled from the container without fracture of the entire TI band and is undesirable, particularly when it is desired to leave the fractured TI band on the finish to indicate prior opening.

In view of the deficiencies in known tamper indicating bands, it is preferable to have a tamper-indicating band which does not "tire" over a container neck or finish bead as a closure is initially removed from the container. It is also preferable that the design allows a more efficient breaking of frangible webs.

SUMMARY OF THE INVENTION

It is an object of the present invention to provide a tamper indicating band frangibly attached to a closure for a container.

It is a further objective of this invention to provide a tamper indicating closure for a container wherein the tamper indicating band will not "tire" over a lower portion of a neck or a finish bead of a container neck as the frangible web is broken and the closure is removed.

It is an even further objective of this invention to provide a tamper indicating closure for a container having neck or finish bead wherein a tamper indicating band has an annular step operably engaging the neck bead.

It is still an even further objective of this invention to provide an inwardly projecting bead disposed below the annular step of the TI band and positioned beneath a lower portion of the container neck bead.

It is yet an even further objective to provide a TI band having a frangible web above the annular step so that the TI band has minimal axial movement downward thereby preventing the tiring effect.

In particular, the invention relates to a TI band having an annular step formed of added plastic material along an inside surface of the TI band in a position above a lower portion of a neck or finish bead of the container. The annular step provides interference with the container neck bead lower portion so that the TI band has minimal downward movement when the container is initially opened. If the TI band is inhibited from sliding downward, all of the frangible webs will rupture when the closure is initially removed and ultimately the TI band will not "tire" over the container neck bead and pull from the container.

More specifically the invention includes a tamper indicating band arrester, comprising a closure having a top wall and skirt depending from a peripheral edge of the top wall. The skirt has a thread extending radially inward from and circumscribing an inner surface thereof, as well as a tamper indicating band releasably connected to the skirt by a plurality of frangible webs.

The tamper indicating band has an annular step extending radially inward from an inner surface of the TI band. The TI band further comprises a TI bead extending radially inward from the lower portion of the TI band, which is positioned axially below the annular step. The annular step is preferably made of molded plastic and further comprises a shelf connecting an upper and a lower step of the plurality of steps.

In addition, the invention may have a container with an open end and an outwardly extending container neck or finish bead below the open end of a container neck. The container neck or finish bead has an upper portion and a lower portion. The annular step of the TI band operably engages the lower portion of the container finish bead. Upon initial opening of the closure, the lower portion of the container finish bead inhibits the detached portion of the TI band from moving downward and, therefore, inhibits the attached portion from "tiring" over the container finish bead.

A TI band bead positioned below the annular step preferably has a smaller diameter than the annular step. The container finish or neck bead comprises an upper portion and a lower portion. The upper portion of the container neck bead has a smaller diameter than the lower portion of the container neck bead.

The tamper indicating band arrester further comprises a knurled finish on an outer surface of the skirt of the closure and has a frangible web located above the annular step. The frangible web is preferably positioned above the annular step and adjacent the upper portion of the container finish bead. The TI band bead has at least one tapered wall or transition bead surface connecting an inner surface TI band to an inner surface of the TI bead.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Generally, a frangible web breaks when a container is initially opened. It is desirable for a TI band to remain on the neck of the container so that a person can visually identify that the container has been previously opened. However, in many cases the frangible webs do not fully rupture resulting in several remaining unbroken webs or bridges between the closure and TI band. In addition, the inner surface of a TI band is typically smooth providing little or no interference with the container neck such that the detached portion of the TI band slips downward along and inward below the container finish bead. When, in combination, the closure is unscrewed, the detached portion of the TI band slips below the container bead and toward the container neck, and the attached portion moves away from the container neck, the TI band often "tires" over the container bead. This results in the TI band being pulled off of the container neck, which is highly undesirable.

Figure 1:
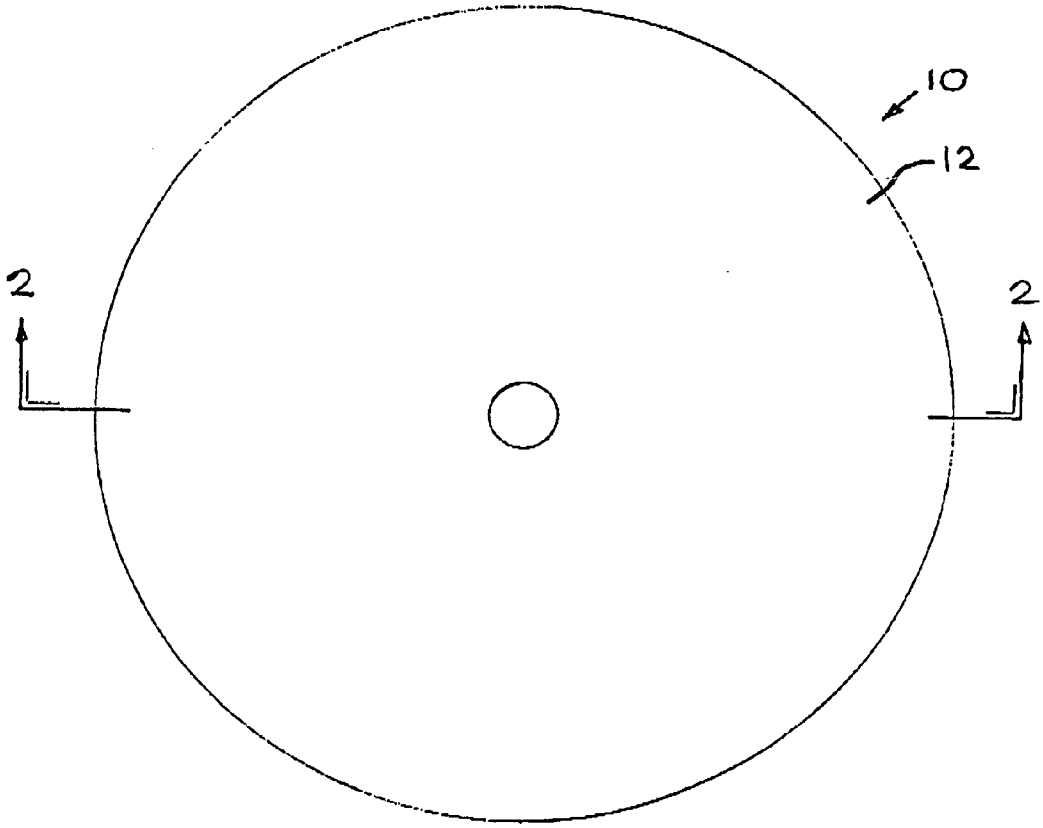
FIG. 1 shows a top view of the closure of the present invention.
Figure 2:
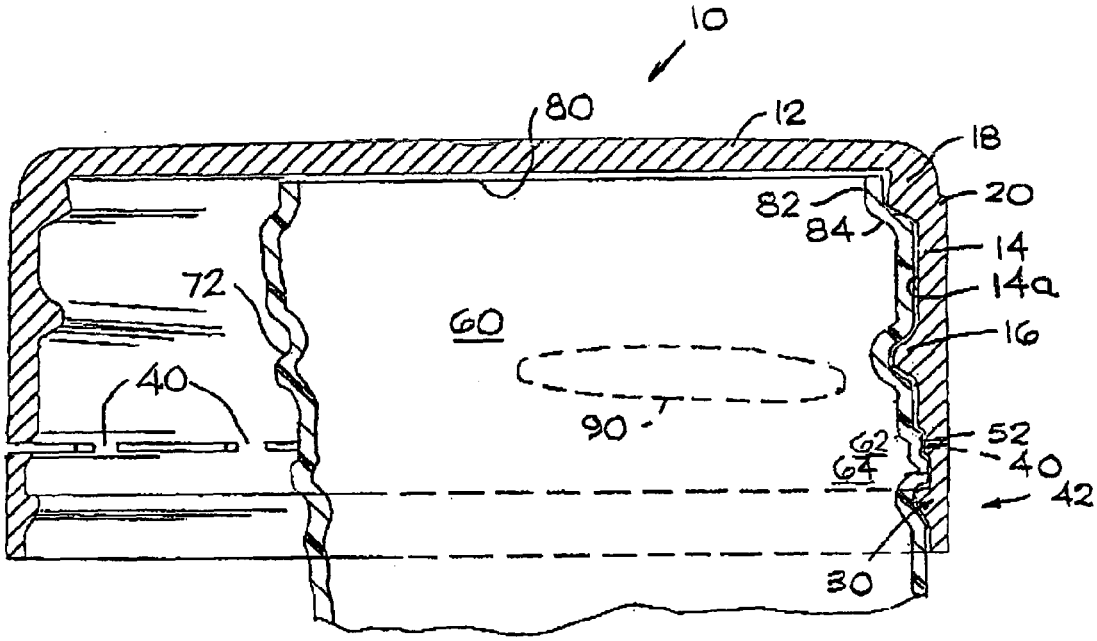
FIG. 2 shows a sectional view along line 2—2 of FIG. 1.

The present invention overcomes this problem and will now be described in conjunction with the drawings, referring initially to FIGS. 2 and 3, where a sectional view of the tamper indicating arrester of the present invention is shown. A closure 10 is shown having a top wall 12 and is preferably made of polypropylene but may be some other type of injection or compression moldable plastic. As shown in FIGS. 1 and 2, the top wall 12 is circular in shape and has a skirt 14 depending from a peripheral edge of the top wall 12. The skirt 14 preferably has a radial thickness $t_1$.

Figure 3:
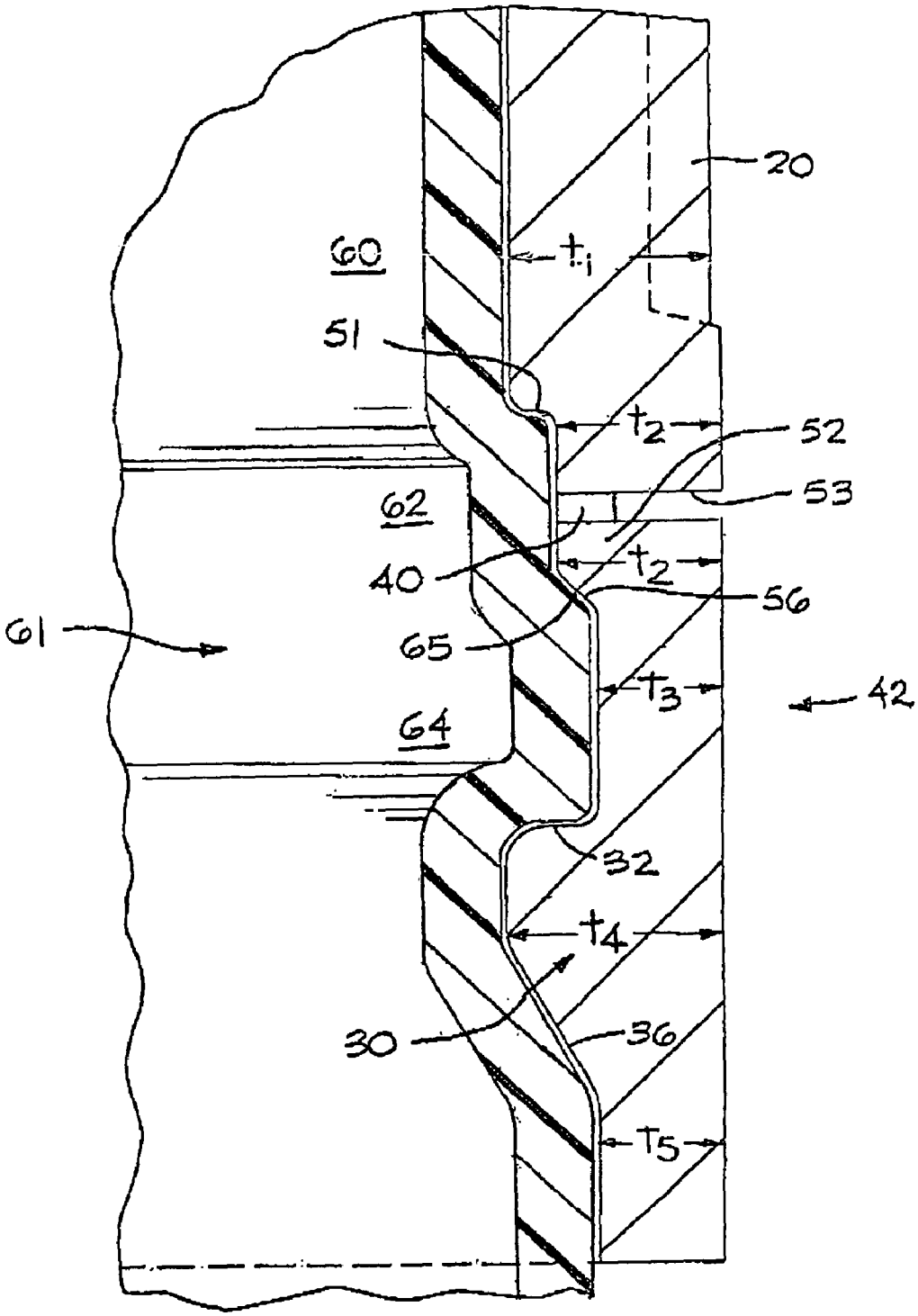
FIG. 3 shows a detail view of the annular step of the TI-band of FIG. 2.
Figure 4:
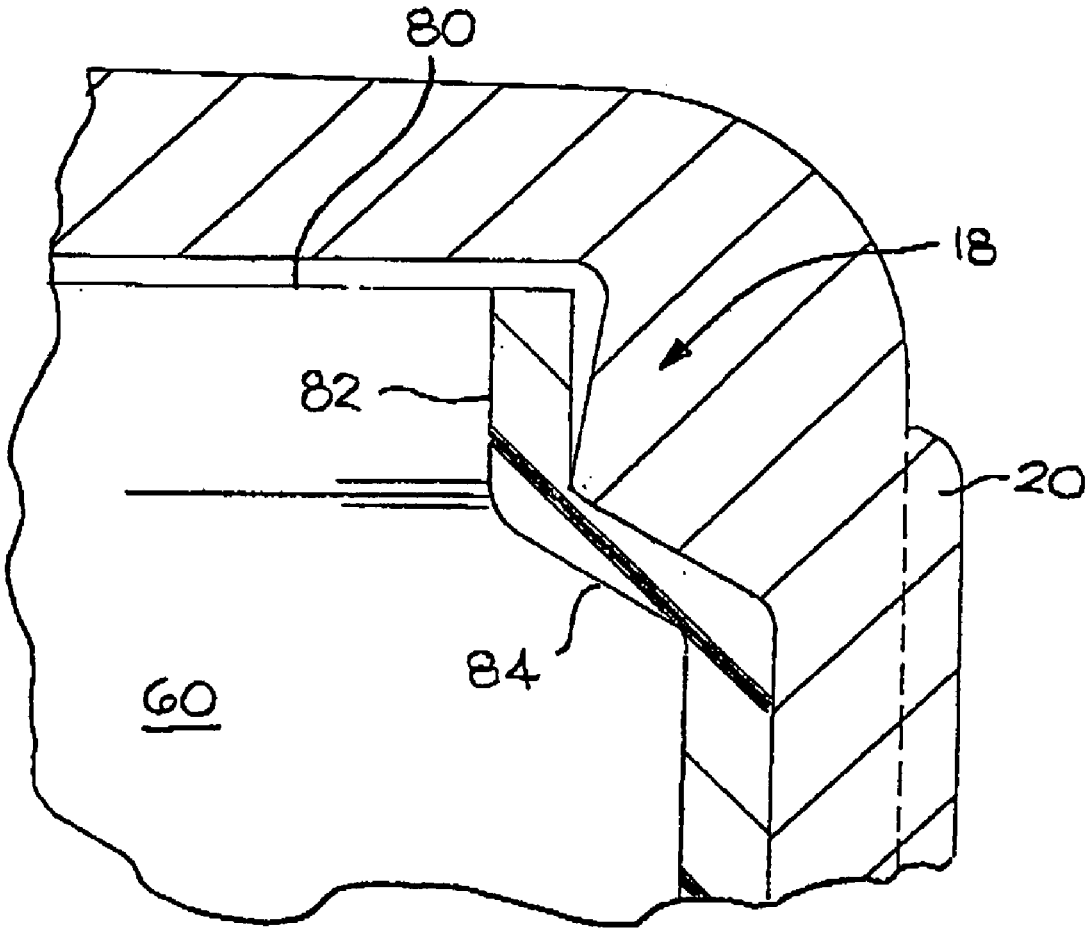
FIG. 4 shows a sectional view of a seal embodiment used in the closure of the present invention.
Figure 5:
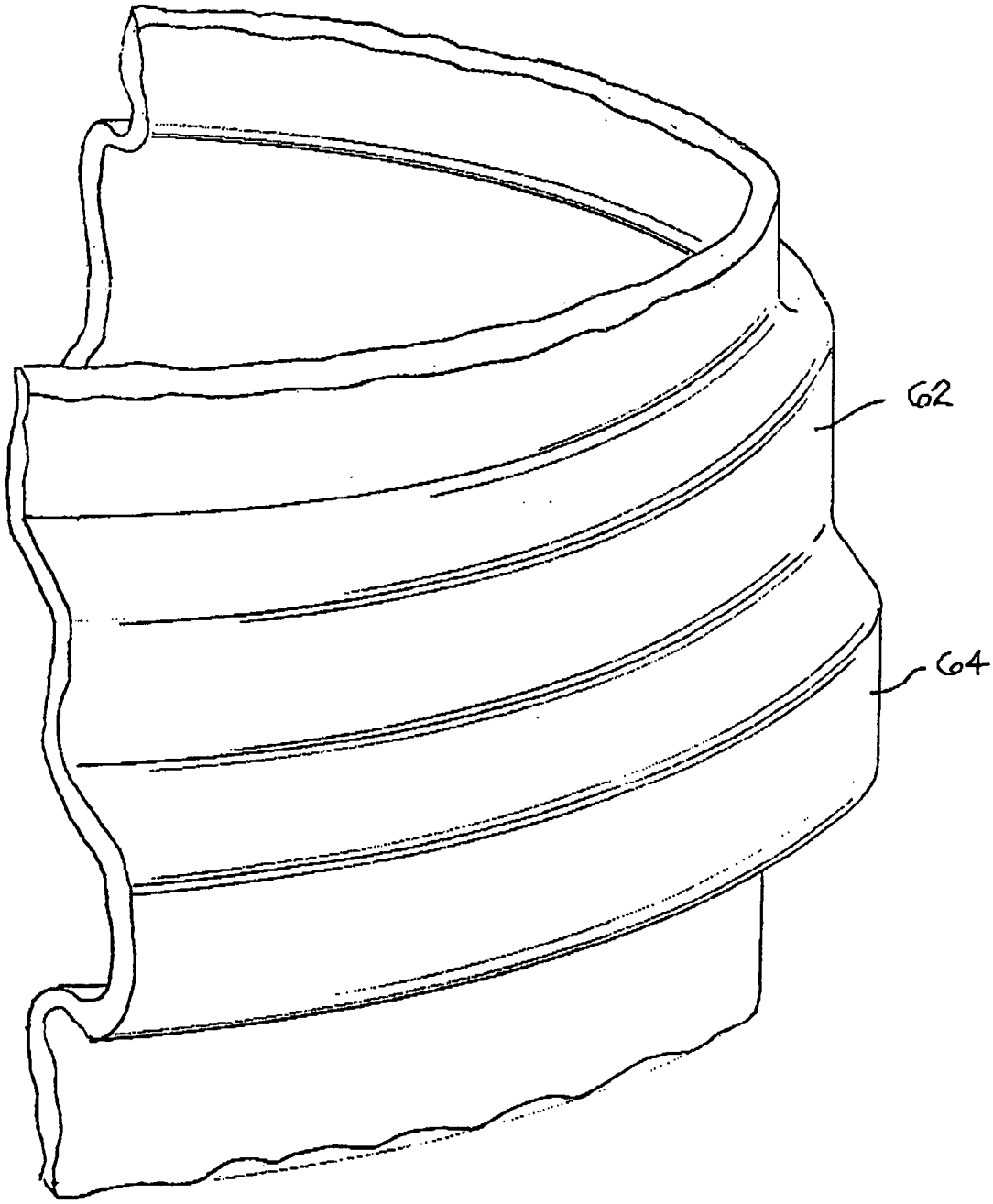
FIG. 5 shows a partial perspective view of the container neck bead upper portion and lower portion of FIG. 2; and, FIG. 6 shows a detail sectional view of a second embodiment of the container neck of the present invention.

As best shown in FIGS. 2, 3, and 4, the skirt 14 has an exterior finish thereon. Most preferably, the skirt exterior has a knurled finish 20 which aids in applying torque to the closure 10 as it is opened and closed. However, other finishes known in the art may be used instead of a knurled finish.

Depending from interior surfaces 14*a* of skirt 14, may be a rotary seal 18, as best seen in FIGS. 2 and 4. The seal 18 depends downwardly and inwardly from the interior surface of the top wall 12 at an angle of preferably about 10 degrees from the vertical. In addition, the seal 18 extends upwardly and inwardly from the skirt 14 interior surface at an angle of preferably about 30 degrees from the horizontal until the two sealing surfaces intersect. The seal 18 engages the container neck 60 and may be of varying angular design. In addition, other types of seals may also be utilized with the instant tamper indicating band arrester such as a plug seal, a reverse taper plug seal, a malleable sealing material positioned along the inner surface of the top wall, or other seals known by one of ordinary skill in the art.

Positioned below the seal 18 of closure 10 is a thread 16. The thread 16 extends radially inward from and helically about an inner surface 14*a* of skirt 14. The thread 16 is rotatably received by a thread or channel 72 extending radially outward from a container neck 60. The closure thread 16 preferably has a pitch of 6 threads per inch, although this may vary depending upon the application. In addition, a load bearing projection 90 may be used to protect the closure seal 18 from stacking load. The load bearing projection 90 is preferably located adjacent the container thread 72.

Along the inner surface of the closure skirt 14 is a ledge 51 operably engaging an upper portion 62 of container finish bead 61. The ledge 51 is defined by a change in the skirt 14 thickness as the thickness changes from $t_1$ to $t_2$. More specifically, the thickness of $t_2$ is preferably less than $t_1$ allowing the upper portion 62 of finish bead 61 to be positioned therein.

In one embodiment, a frangible web or bridge 40 is located along a lower peripheral edge 53 of closure skirt 14 releasably connecting skirt 14 to the TI band 42. One of ordinary skill in the art will understand that the frangible web 40 should be located adjacent the upper portion of finishing bead 62, thereby positioning an annular step 52 above the lower portion 64 of finish bead 61. For purpose of this application the annular step is defined as the upper portion of TI band 42 having thickness $t_2$, best seen in FIG. 3, between the frangible web 40 and the portion of the TI band 42 having thickness $t_3$. Due to the change in thickness of TI band 42 at TI band transition 56, the finish bead 61 reduces the downward axial movement of the TI band 42 and thereby allows the full breakage of the frangible webs 40. In addition, this prevents the tiring effect described above. Thus, the webs 40 must be fractured entirely before the closure 10 can be removed from the container without the band 42 tiring over the finish bead 61.

A rotary cutter may form the frangible web 40 by cutting through nearly all of the plastic of the closure 10 and TI band 42, above the annular step 52, in an interrupted pattern forming a frangible web 40 best shown in FIGS. 2 and 3. The cut forming the frangible web 40 generally defines the TI band 42, therebeneath. Because the annular step 52 has a thickness $t_2$, which is preferably greater than the TI band 42 thickness $t_3$, special care should be taken to insure that the slits in the frangible web 40 are cut deep enough. If the cuts or slits are not deep enough the force required to break the webs or bridges 40 will be too high. This will result in the closure 10 pulling the TI band 42 over the container bead 64 as the closure 10 is removed.

Generally, a TI band is formed having a thickness equal to the skirt thickness. In other words, the inner surface of a TI band would be vertical with no step, shoulder, rib, or the like. However, since the annular step 52 of the TI band 42 extends radially inward, the cutter must make a deeper cut when forming the frangible bridge 40. In this invention, the cutter must account for extra plastic having a thickness equal to the radial difference between the radial thickness $t_2$ and $t_3$. This difference may be between about one-hundredth of an inch (0.01") and seven-hundredths of an inch (0.07"), but may vary depending on the application. The cutting action may be performed with a modified cutting tool, such as a rotary cutter, to account for the extra thickness in the area of the frangible web 40. The frangible webs or bridges 40 may alternatively be cut using water, laser, or other cutting means known in the art. In yet another alternative the webs may be molded in place. One of ordinary skill in the art will also recognize that the frangible web 40 should be positioned above the annular step 52 and above the TI band transition 56 connecting step 52 and TI band 42. The rotary cutter preferably cuts from the outside of the TI band 42 inwardly but may instead cut outwardly from an interior side of the cap 10. This positioning of the frangible web 40 insures that when the frangible web 40 is broken, the TI band 42 should not fall below neck bead 61 since the annular step 52 has a smaller diameter than lower portion 64 of neck bead 61.

The annular step 52 is positioned beneath the frangible web 40, as best shown in FIG. 3. The annular step 52 has a thickness $t_2$ and a diameter smaller than the diameter of the finish bead lower portion 64. This provides interference between the TI band 42 and the lower portion 64 of the finish bead 61 along a TI band transition 56 and finish bead transition 65. The interference reduces the distance the TI band 42 slips below a lower portion 64 of container finish bead 61. Moreover, the interference inhibits the detached portion of the TI band 42 from moving toward the container neck 60, and the attached portion of the TI band 42 from moving away from container neck 60. Therefore, the TI band 42 is inhibited from "tiring" over the lower portion 64 of finish bead 61. As a result, the frangible web 40 will fully rupture and the TI band 42 will remain in place on the container neck 60 when the closure 10 is rotatably removed.

The bottom of annular step 52, is tapered. The tapered connection forms a TI band transition 56 adjacent a finish bead transition surface 65 between the upper portion 62 and lower portion 64 of finish beads 61. The finish bead transition surface 65 causes interference with the TI band transition 56 inhibiting TI band 42 from tiring over the lower portion 64 of finish bead 61 and also provides a means to prevent tiring between the finish bead 61 and TI band 42.

According to an embodiment of the instant invention, extra plastic is used to form the annular step 52 which engages an upper portion 62 of finish bead 64 and is positioned adjacent a finish bead transition surface 65. The annular step 52 is preferably formed by removing a portion of the mold steel in the mold. By removing steel from the mold, a cavity is created which fills with plastic during the molding process, for instance injection or compression molding, thereby forming the step feature.

Extending inwardly from TI band 42 is an annular bead 30. Annular bead 30 has a smaller diameter than container neck bead 64 and thickness defined as $t_4$. In cross section, as shown in FIG. 3, bead 30 at its upper most point extends inwardly from an inner surface of TI band 42 and then downwardly forming a TI band contacting surface 32. The TI band contacting surface 32 can be either flat or tapered. The annular bead 30 is also tapered outwardly along tapered wall TI bead transition 36 toward TI band 42. Tapered wall 36 encourages the annular bead 30 to pass the finish bead 61 as the closure 10 and TI band 42 are placed on the container neck 60. Beneath the tapered wall 36, TI band 42 continues depending downward having a thickness $t_s$.

As best seen in the sectional views FIGS. 2 and 4, upper container neck 70 has an opening 80 at an upper end. The container neck 60 extends downwardly along surface 82 and then tapers outwardly along surface 84 before depending downwardly to thread 72. Surfaces 82 and 84 work in cooperation with seal 18 of closure 10 to prevent leakage, spillage, and the like. Below thread 72, lower container neck 60 continues downward to a container finish bead 61 having an upper portion 62 and lower portion 64. The lower portion 64 of finish bead 61 extends radially outward from container neck 60 beyond the upper portion 62 between about 0.01 and 0.07 and preferably about 0.03 of an inch. From upper portion 62 of finish bead 61, the container neck 60 tapers radially outward along the finish bead transition 65 to the lower portion 64 of finish bead 61. The finish bead transition 65 provides interference for TI band transition 56 such that the annular step 52 cannot pass finish bead lower portion 64. The finish bead transition surface 65 in combination with the TI bead transition 36 of TI band bead 30 work in cooperation to allow annular bead 30 to pass by the lower portion 64 of finish bead 61 during initial placement of closure 10 on the neck 60.

Figure 6:
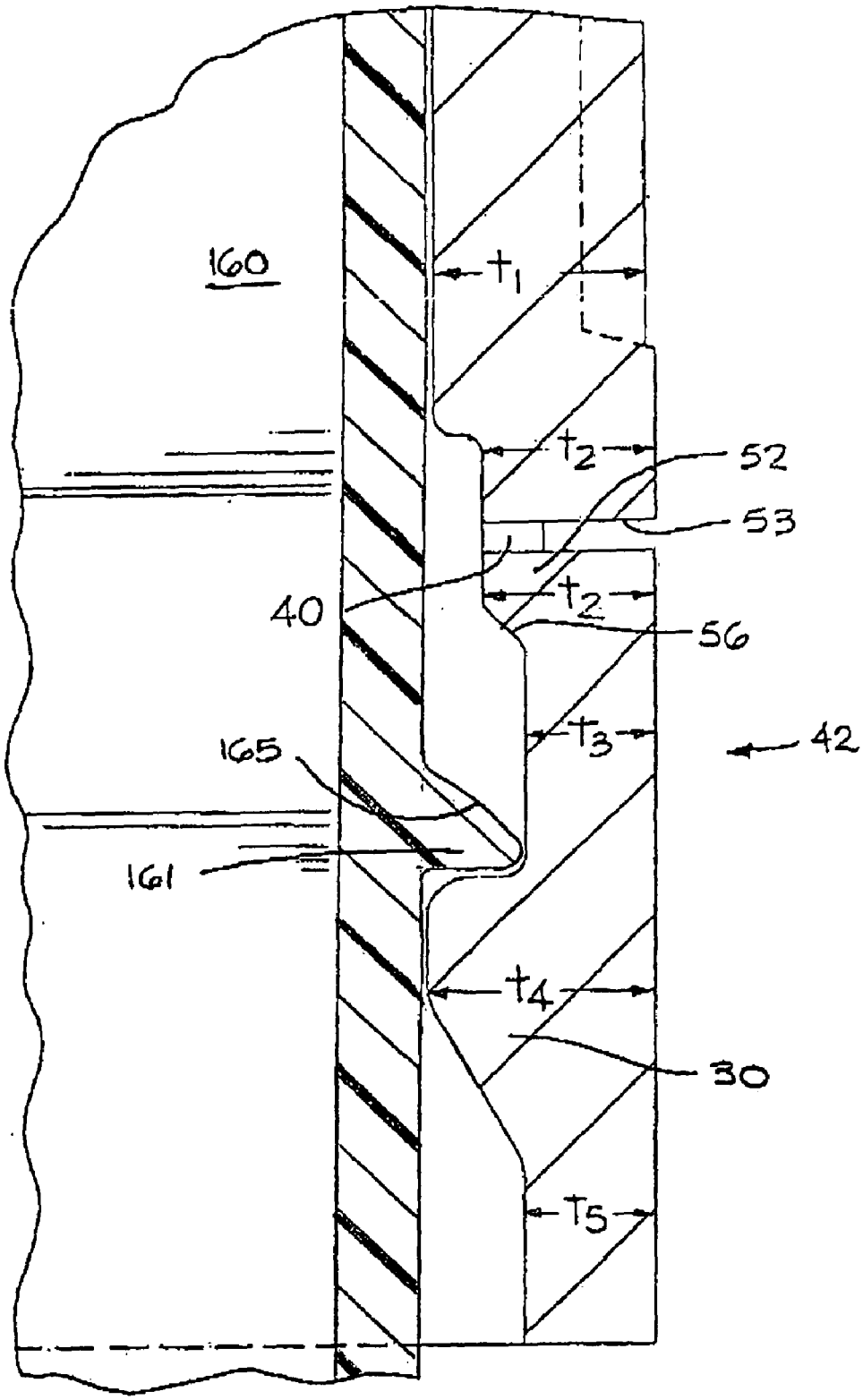

In a second embodiment of the instant invention a container neck 160 is shown in FIG. 6. Directed radially outward from container neck 160 is a bead 161. The finish bead 161 extends radially outward between about 0.01" and 0.1". Preferably, the finish bead 161 is directed radially outward about 0.03". The bead 161 does not have an upper portion and a lower portion as with the previous embodiment. This forms a gap between TI band transition 56 and the finish bead transition 165 of container neck 160. The spacing or gap between TI band transition 56 and finish bead transition 165 may be between about 0.01 inches and 0.07 inches. Although this may allow the TI band 42 to partially move downward during opening of the closure from the container, the amount of displacement is not enough to allow the tiring effect discussed above. In addition the limited axial movement allows increased flexing of the frangible web 40 which allows full breakage of the web 40.

As in the previous embodiment the closure 10 has an area of first thickness $t_1$ and a second thickness $t_2$. A cut forming a frangible web 40 defines the TI band 42. An upper portion of the TI band 42 has an annular step 52. The TI band 42 also has a TI bead 30 disposed beneath the container finish bead 161. Like the previous embodiment, the combination of container neck 161, closure 12 and the TI band 42 provide for full breakage of the frangible web 40.

The annular step 52 of the TI band 42 also provides another advantage for the instant invention. The thickness of annular step 52 provides strength and rigidity to the TI band 42 as it is preferably threaded onto the container neck 60 and over the upper portion 62 and lower portion 64 of finish bead 61.

When the closure 10 and TI-band 42 are fully formed, they are placed on the container neck 60 by threading thereon. The closure 10 should be fully threaded onto the container neck 60 until TI bead 30 locks below the lower portion 64 of finish bead 61. In other words, threading of the closure discontinues when TI band contacting surface 32 is beneath finish bead 61. When the TI bead 30 is locked below finish bead 61 the frangible webs 40 should fully rupture when the closure 10 is initially rotatably opened.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A closure container combination apparatus with a tamper indicating band arrester, comprising:

a closure having a top wall and skirt depending from a peripheral edge of said top wall;

said skirt having a thread extending radially inward from an inner surface thereof;

a tamper indicating band releasably connected to said skirt by a plurality of frangible webs;

an annular step extending inwardly from an inner surface of said tamper indicating band;

a tamper indicating bead extending radially inwardly from said tamper indicating band, said bead positioned axially below said annular step and having a substantially horizontal upper surface and inhibiting lateral force components;

a corresponding container with a container neck and a finish bead having an upper portion defined by a first diameter and a lower portion defined by a second diameter each extending about said container neck, said first diameter and said second diameter joined by a finish bead transition surface extending radially outward from said upper portion to said lower portion, and said finish bead having a substantially horizontal lower surface extending from said neck;

said annular step operably engaging said finish bead transition surface when said closure is in a fully applied position on the container; and, said tamper indicating bead being positioned below said lower portion of said finish bead and having a smaller diameter than said lower portion of said finish bead.

2. The closure apparatus with a tamper indicating band arrester of claim 1 further comprising a knurled finish on an outer surface of said skirt.

3. The closure apparatus with a tamper indicating band arrester of claim 1, wherein said frangible webs are adjacent with an upper portion of said finish bead.

4. The closure apparatus with a tamper indicating band arrester of claim 1 further comprising a rotary seal depending downwardly and inwardly from said top wall and extending upwardly and outwardly from said skirt.

5. A closure and container combination, comprising:

a closure having a top wall and skirt depending from a peripheral edge of said top wall;

said skirt having a thread extending radially inward from an inner surface thereof;

a tamper indicating band frangibly connected to said skirt by a plurality of frangible webs;

said tamper indicating band having an annular step extending radially inwardly from an inner surface of said tamper indicating band;

a tamper indicating bead extending radially inwardly from said tamper indicating band, said tamper indicating bead positioned axially below said annular step and having a substantially horizontal upper surface and inhibiting lateral force components;

a container having an open end and an annular neck bead below said open end;

said neck bead having an upper portion with a substantially vertical wall of a first diameter and a lower portion with a substantially vertical wall of a second diameter, said upper and lower portions having a neck bead transition extending radially outwardly from said upper portion to said lower portion, and said neck bead having a substantially horizontal lower surface extending from a neck of said container;

said annular step operably engaging said neck bead transition when said closure is in a fully applied position on the container;

said annular step of said tamper indicating band in interfering relationship with said lower portion of said neck bead.

6. The closure container combination of claim 5, said tamper indicating bead being positioned below said annular step and having a smaller diameter than said annular step.

7. The closure and container combination of claim 5, said container neck bead comprising an upper and a lower portion.

8. The closure and container combination of claim 7, said container neck bead upper portion having a smaller diameter than said container neck bead lower portion.

9. The closure and container combination of claim 5, further comprising a knurled finish on an outer surface of said skirt.

10. The closure and container combination of claim 5, wherein said plurality of frangible webs are located above said annular step and adjacent said upper portion of said finish bead.

11. The closure and container combination of claim 5, wherein said plurality of frangible webs are located adjacent said upper portion of said neck bead.

12. The closure and container combination of claim 5, said tamper indicating bead having at least one tamper indicating bead transition on said inner surface of said tamper indicating band.

13. A closure and container combination, comprising:

a closure having a top wall and skirt depending from a peripheral edge of said top wall;

said skirt having a thread extending radially inward from an inner surface thereof;

a tamper indicating band frangibly connected to said skirt by a plurality of frangible webs;

said tamper indicating band having an annular step extending radially inwardly from an inner surface of said tamper indicating band, said plurality of frangible webs extending from an upper surface of said annular step;

a tamper indicating bead extending radially inwardly from said tamper indicating band, said tamper indicating bead positioned axially below said annular step and having a substantially horizontal upper surface and inhibiting lateral force components;

a container having an open end and an annular neck bead below said open end, said neck bead having a substantially horizontal lower surface extending from said neck;

said annular step of said tamper indicating band in interfering relationship with said neck bead.

* * * * *